US006315168B1

(12) United States Patent
Bolyard, Jr. et al.

(10) Patent No.: US 6,315,168 B1
(45) Date of Patent: Nov. 13, 2001

(54) REMOVABLE INLINE NOZZLE FILTER

(75) Inventors: Edward W. Bolyard, Jr., Old Hickory; Daniel D. Bourget, Hendersonville, both of TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/576,554

(22) Filed: May 24, 2000

(51) Int. Cl.[7] ..... B67D 5/58; B67D 3/00

(52) U.S. Cl. ..... 222/189.06; 222/189.11; 222/559; 222/146.5; 239/DIG. 23

(58) Field of Search ..... 222/189.06, 189.11, 222/504, 559, 146.5; 239/DIG. 23; 251/129.18

(56) References Cited

U.S. PATENT DOCUMENTS 688,086 * 12/1901 Grossman ..... 222/189.06
5,065,979 * 11/1991 Detweiler et al. ..... 251/129.16
5,975,357 * 11/1999 Topar ..... 222/189.06
6,015,103 * 1/2000 Kotkowicz ..... 239/585.4

* cited by examiner

*Primary Examiner*—Kevin Shaver
*Assistant Examiner*—Stephen Willatt
(74) *Attorney, Agent, or Firm*—Schwartz & Weinrieb

(57) ABSTRACT

A hot melt adhesive dispensing valve assembly comprises a removable inline nozzle filter which is mounted within the hot melt adhesive dispensing valve assembly at a position or location which is immediately upstream of the hot melt adhesive dispensing valve assembly nozzle. The filter member or component is interposed between the valve seat for the hot melt adhesive dispensing valve which is formed within the hot melt adhesive dispensing valve assembly adapter and the hot melt adhesive dispensing valve assembly nozzle which is threadedly mounted within the adapter. As a result of this disposition of the inline nozzle filter, any residual or remaining particles or debris, which were not previously filtered, caught, or trapped by means of the primary filter component disposed within the filter block of the hot melt adhesive dispensing head assembly will, now be filtered, caught, and trapped by means of the inline nozzle filter component whereby clogging or blocking of the valve assembly dispensing nozzle is effectively prevented.

18 Claims, 3 Drawing Sheets

REMOVABLE INLINE NOZZLE FILTER

FIELD OF THE INVENTION

The present invention relates generally to fluid dispensing head assemblies, and more particularly to a new and improved removable inline nozzle filter which is incorporated within the valve assembly component of the overall fluid dispensing head assembly so as to be disposed immediately upstream of the valve nozzle in order to trap any minute particles or debris which could otherwise clog or block the dispensing nozzle.

BACKGROUND OF THE INVENTION

Fluid dispensing head assemblies, whether they are used for dispensing or depositing hot melt adhesives, plastic extrusion materials, cosmetic lotions, or the like, are of course well known. Such fluid dispensing head assemblies, such as, for example, hot melt adhesive dispensing head assemblies, normally comprise filter mechanisms or components which are disposed within a filter block to which a hot melt adhesive supply conduit is fixedly connected. More particularly, the filter mechanism or component is conventionally disposed within the filter block immediately downstream of the fluidic connection defined between the hot melt adhesive supply conduit and the filter block.

While such filter component or mechanism therefore filters or entraps most particles or debris whereby such debris or particles do not contaminate the hot melt adhesive, debris or particles as small as, or smaller than, 0.005 inches sometimes find their way or migrate through the system, ultimately clogging or blocking nozzles which may have small orifices on the order of 0.010–0.015 inches in diameter. Such particles can be released, for example, during primary filter change operations whereby stagnant debris disposed around the filter component may be dislodged or otherwise stirred up or released, or alternatively, such particles can be formed within the adhesive head assembly after the primary filtration has taken place within the aforenoted filter block upstream and remote from the dispensing valve assembly nozzle. Regardless of how such particles or debris are formed or find their way into the adhesive dispensing system, it is desirable to catch or entrap such particles before they enter the dispensing valve assembly nozzle.

A need therefore exists in the art for a removable inline nozzle filter which can effectively be incorporated within the dispensing valve assembly at a position or location immediately upstream of the dispensing nozzle so as to catch, filter, or entrap any particles or debris which may nevertheless still be present within the system despite previous filtration of the hot melt adhesive within the conventional filter block assembly at a position or location upstream and remote from the dispensing nozzle.

OBJECTS OF THE INVENTION

Accordingly, it is an object of the present invention to provide a new and improved removable inline nozzle filter for incorporation within a hot melt adhesive dispensing head assembly.

Another object of the present invention is to provide a new and improved removable inline nozzle filter for incorporation within a hot melt adhesive dispensing head assembly which is able to overcome the operational drawbacks or deficiencies of conventional hot melt adhesive dispensing head assemblies.

An additional object of the present invention is to provide a new and improved removable inline nozzle filter for incorporation within a hot melt adhesive dispensing head assembly which is able to overcome the operational drawbacks or deficiencies of conventional hot melt adhesive dispensing head assemblies by filtering or trapping small particles or debris which may block or clog the hot melt adhesive dispensing valve assembly nozzle.

A further object of the present invention is to provide a new and improved removable inline nozzle filter for incorporation within a hot melt adhesive dispensing head assembly which is able to overcome the operational drawbacks or deficiencies of conventional hot melt adhesive dispensing head assemblies by filtering or trapping small particles or debris which may block or clog the hot melt adhesive dispensing valve assembly nozzle as a result of the disposition of the removable inline nozzle filter within the hot melt adhesive dispensing valve assembly at a position or location which is immediately upstream of the hot melt adhesive dispensing valve assembly nozzle.

SUMMARY OF THE INVENTION

The foregoing and other objectives are achieved in accordance with the teachings and principles of the present invention through the provision of a new and improved removable inline nozzle filter which comprises a filter member or component which is mounted within the hot melt adhesive dispensing valve assembly at a position or location which is immediately upstream of the hot melt adhesive dispensing valve assembly nozzle. More particularly, the filter member or component is interposed between the valve seat for the hot melt adhesive dispensing valve which is formed within the hot melt adhesive dispensing valve assembly adapter and the hot melt adhesive dispensing valve assembly nozzle which is threadedly mounted within the adapter. In order to change or replace the inline nozzle filter member or component, the nozzle is simply removed from the valve assembly adapter by unthreading the nozzle from the valve assembly adapter, re- moving the old inline nozzle filter member, inserting a new inline nozzle filter member, and remounting the nozzle upon the valve assembly adapter by again threadedly engaging the nozzle with the valve assembly adapter. The inline nozzle filter will significantly increase the operational time of the hot melt adhesive dispensing valve assembly before servicing of the adhesive nozzle is again required.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
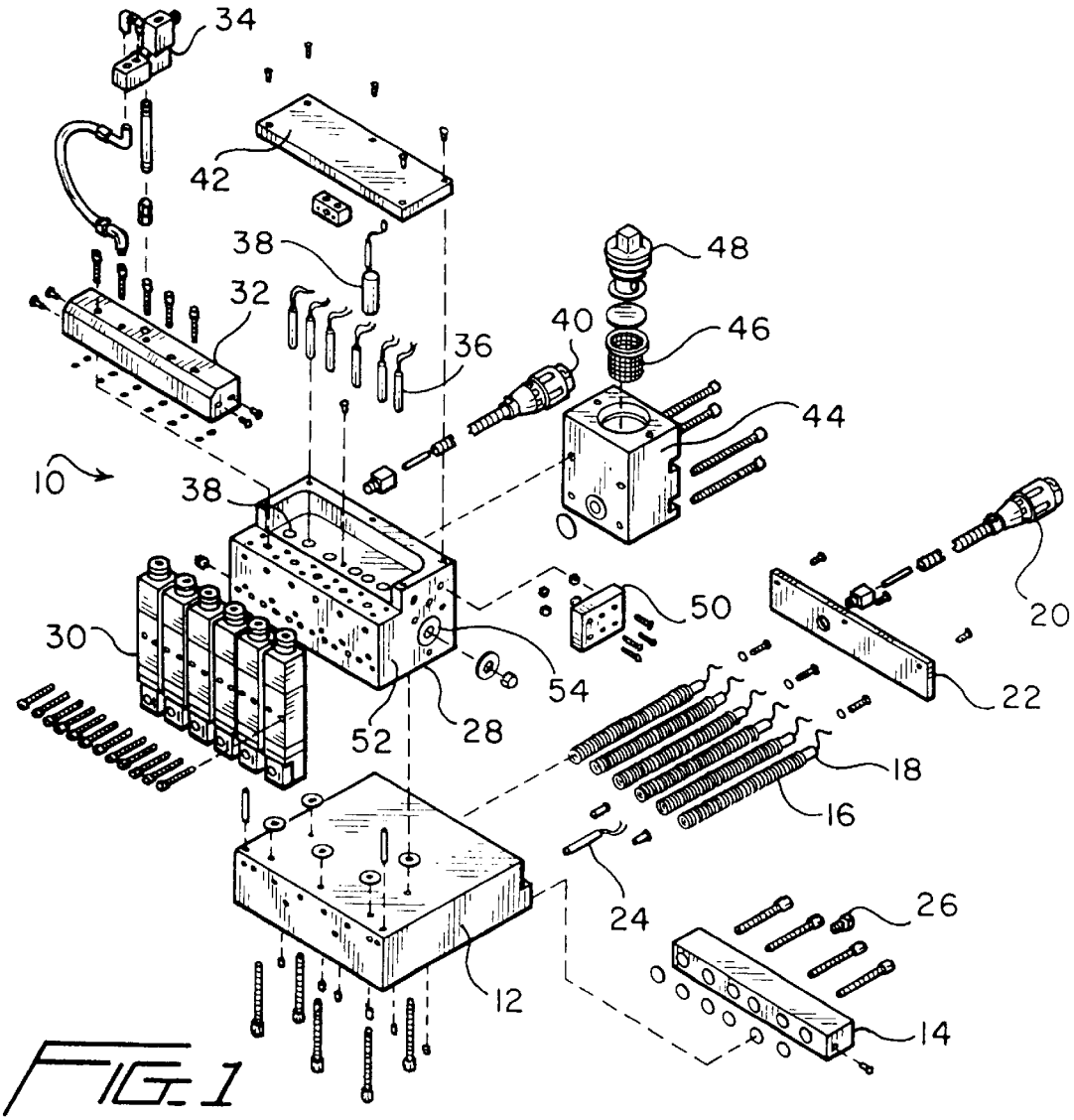
FIG. 1 (PRIOR ART)
FIG. 1 is an exploded view of a conventional PRIOR ART hot melt adhesive dispensing head assembly.

Referring now to the drawings, and more particularly to FIG. 1 thereof, a conventional or PRIOR ART fluid dispensing head assembly will initially be described merely for background purposes so as to provide a foundation or environment within which the new and improved hot melt adhesive valve dispensing assembly, having the removable inline nozzle filter member or component incorporated therein, can be used. It is also to be initially noted that while the fluid dispensing head assembly will be described for particular use in connection with the dispensing or deposition of hot melt adhesive, the fluid dispensing head assembly can alternatively be used in connection with the dispensing of fluids other than hot melt adhesives, such as, for example, cosmetic lotions, plastic materials, or the like.

Accordingly, as is therefore seen in FIG. 1, the fluid or hot melt adhesive dispensing head assembly is illustrated and is generally indicated by the reference character 10. The assembly 10 is seen to comprise an air heater block 12 which has an air distribution block 14 operatively associated therewith, and within which a plurality of hollow air heater coils 16 are adapted to be disposed for heating incoming air for operative association with the hot melt adhesive which is to be dispensed or deposited, for example, upon a suitable substrate. The heater coils 16 have electrical cartridge heaters 18 respectively inserted therein, and an electrical connector 20 provides electrical power to the cartridge heaters 18. An air heater block cover plate 22 is adapted to be secured to the rear face of the air heater block 12 so as to close or cover such rear open face thereof. Lastly, a temperature sensor 24 is provided for controlling the energization of the cartridge heaters 18 so as to in turn control the temperature of the incoming air. Incoming air is supplied to the air distribution block 14 by means of an air hose connector 26 which is fluidically connected to a suitable air regulator, not shown.

A service block 28 is adapted to be mounted atop the air heater block 12, and the service block 28 has operatively associated therewith, and mounted upon the front face thereof, a plurality of hot melt adhesive dispensing valves 30. As illustrated, it is seen that the width dimension of the service block 28 is such as to accommodate, house, or mount, for example, six (6) adhesive dispensing valves 30 upon the front face thereof. The service block 28 has further mounted upon a front region thereof an air manifold 32 which is adapted to effectively fluidically route, convey, or conduct inlet control air to the adhesive dispensing valves 30 so as to actuate the same. The admission of the inlet control air into the air manifold 32 is controlled by means of a suitable solenoid mechanism 34. A plurality of adhesive material heaters 36 are adapted to be mounted or inserted into respective bores formed within the upper region of the service block 28, and a temperature sensor mechanism 38 is provided in conjunction with the adhesive material heaters 36 so as to suitably energize the same in accordance with predetermined sensed temperature levels. An electrical connector 40 is also adapted to be operatively mounted upon the service block 28 so as to provide electrical power to the adhesive material heaters 36 as well as to the temperature sensor mechanism 38. A head or service block cover plate 42 is also mounted upon the upper surface of the service block 28 so as to close and seal the upper region of the service block 28.

It is lastly noted that a filter block 44 is mounted upon a rear or back surface portion of the service block 28, and the filter block 44 is provided with a basket-type filter component 46 as well as a threaded plug or nut 48 which is threadedly engaged within the filter block 44 so as to retain the filter component 46 therewithin. The filter component 46 serves to filter any debris or particles which may be contained within the incoming adhesive material which is conducted into the filter block 44 through means of a suitable port, not shown, provided within a rear surface portion of the filter block 44. In order to mount the fluid dispensing head assembly 10 upon the adhesive dispensing or deposition machine, not shown, a mounting plate or bracket 50 is also adapted to be fixedly secured to a side wall 52 of the service block 28. The mounting plate or bracket 50 also serves to thermally isolate the fluid dispensing head assembly 10 from the adhesive dispensing or deposition machine, not shown.

As has been previously noted, primary filtration of the incoming hot melt adhesive as supplied to the hot melt adhesive dispensing valve assemblies 30 through means of the filter block 44 and the service block 28 is conventionally provided by means of, for example, basket-type filter component 46. However, particles or debris can and have nevertheless found their way or migrated through the system so as to eventually clog or block the dispensing valve assembly dispensing nozzle. In accordance then with the principles and teachings of the present invention, a removable inline nozzle filter member or component is adapted to be incorporated within the hot melt adhesive dispensing valve assembly so as to in effect provide secondary or second-stage filtration of the hot melt adhesive material being conducted through the dispensing valve assembly and toward the dispensing nozzle.

Figure 2:
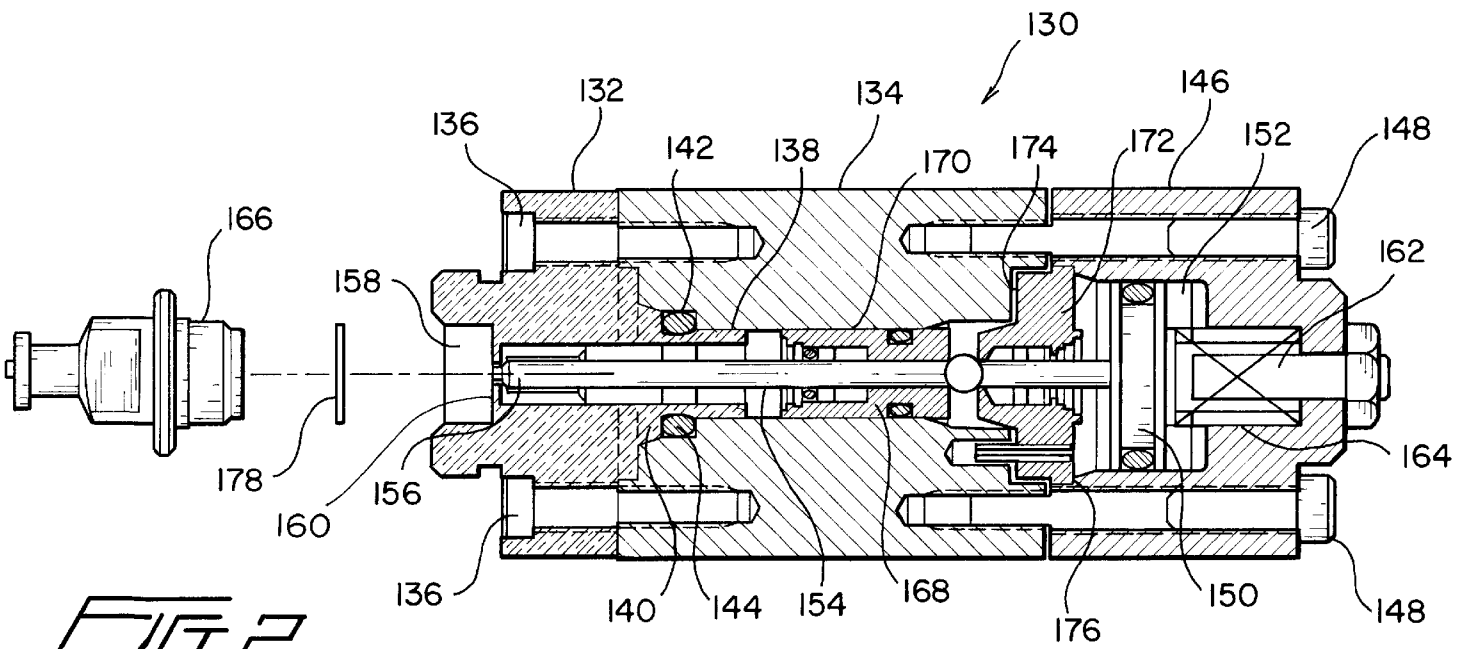
FIG. 2 is an exploded view, partially in cross-section, of a first embodiment of a new and improved hot melt adhesive valve dispensing assembly having the removable inline nozzle filter member or component incorporated therein.
Figure 3:
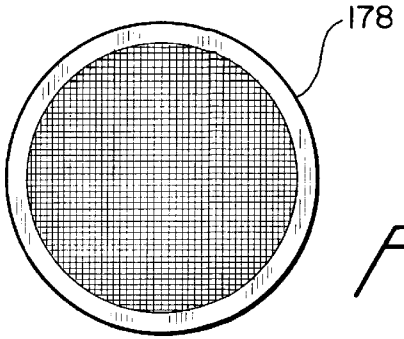
FIG. 3 is an enlarged front elevational view of the removable inline nozzle filter member or component which is incorporated within the new and improved hot melt adhesive valve dispensing assembly shown in FIG. 2.

With reference therefore being made to FIGS. 2 and 3, a first embodiment of the new and improved hot melt adhesive dispensing valve assembly, which corresponds to any one of the plurality of hot melt adhesive dispensing valve assemblies 30 disclosed within FIG. 1, is disclosed within FIG. 2 and is generally indicated by the reference character 130. More particularly, the new and improved hot melt adhesive dispensing valve assembly 130 is seen to comprise a forwardly disposed valve adapter 132 and a centrally located valve body 134 to which the valve adapter 132 is fixedly bolted by means of a plurality of bolt fasteners 136. The valve body 134 is provided with an axial throughbore 138, and the downstream or forward end of the bore 138 accommodates or houses a rearwardly projecting portion 140 of the valve adapter 132. The axial throughbore 138 of the valve body 134 further includes a stepped or shouldered portion 142 within which an annular O-ring sealing member 144 is disposed.

A rearwardly disposed air cylinder 146 is fixedly connected to the rear or upstream end of the valve body 134 by means of suitable bolt fasteners 148, and a piston head 150 is movably disposed within a cylinder chamber 152 of the air cylinder 146. The piston head 150 is integrally connected to an axially extending piston rod or stem 154 and the forward or downstream end of the piston rod or stem 154 forms in effect the hot melt adhesive dispensing valve 156. The valve adapter 132 has a recessed portion or socket 158 defined within the forward or downstream end thereof, and the rear wall of the recessed portion or socket 158 is apertured and effectively defines a valve seat 160. The dispensing valve 156 is normally seated upon the valve seat 160 under the biasing influence of a spring mechanism 162 which is disposed within a recessed portion 164 of the air cylinder 146 and which is engaged with the piston head 150.

The internal region of the recessed portion or socket 158 is threaded, and a valve assembly dispensing nozzle 166 is externally threaded so as to threadedly engage the threaded recessed portion or socket 158 by means of which the dispensing nozzle 166 is fixedly retained within the recessed portion or socket 158. The piston assembly comprising the piston head 150 and piston rod 154, and therefore the dispensing valve 156, are adapted to be moved rearwardly against the biasing force of the spring mechanism 162 by means of control air, which is routed into the air cylinder 146 through means of a conduit not shown in the drawing, and it can therefore be appreciated that when such control air acts upon the piston head 150, the dispensing of the hot melt adhesive through the valve assembly 130, past the dispensing valve 156, and out through the valve assembly dispensing nozzle 166 can occur. It is lastly noted that a sealing cartridge 168, for providing appropriate seals with respect to the hot melt adhesive and control air fluids being conducted through or within the valve assembly 130, has a forwardly projecting portion 170 disposed within the axial throughbore 138 of the valve body 134, while a head portion 172 of the sealing cartridge 168 is seated within respective recessed portions 174,176 of the valve body 134 and air cylinder 146.

In accordance with the specific principles and teachings of the present invention, and in order to catch or trap particles or debris which for some reason were not caught or trapped by means of the primary filter mechanism 46 disposed within the filter block 44, as shown within FIG. 1, the hot melt adhesive dispensing valve assembly 130 is further provided with a removable inline nozzle filter 178 which is illustrated in both FIGS. 2 and 3. The inline nozzle filter 178 is adapted to be removably disposed within the upstream end portion of the recessed portion or socket 158 defined within the valve adapter 132.

More particularly, the inline nozzle filter 178 is adapted to be interposed between the valve assembly dispensing nozzle 166 and the end wall of the recessed portion or socket 158 which defines the valve seat 160 such that when the valve assembly dispensing nozzle 166 is threadedly engaged within the recessed portion or socket 158, the removable inline nozzle filter 178 is in effect fixedly secured within the recessed portion or socket 158 of the valve adapter 132 and is seated upon the downstream side of the end wall defining the valve seat 160. It can thus be appreciated that the removable inline nozzle filter 178 is disposed immediately upstream of the valve assembly dispensing nozzle 166 so as to in fact filter, catch, or trap any remaining or residual particles or debris which may still be present within the hot melt adhesive being conducted through the dispensing valve assembly 130 as a result of such remaining or residual particles or debris not having been previously filtered, caught, or trapped by means of the primary filter mechanism or component 46 disposed within the upstream filter block 44. In this manner, the hot melt adhesive being conducted through the dispensing valve assembly 130 is filtered just prior to its conveyance through the valve assembly dispensing nozzle 166 such that the nozzle 166 does not become clogged or blocked by means of any residual or remaining particles or debris.

Figure 4:
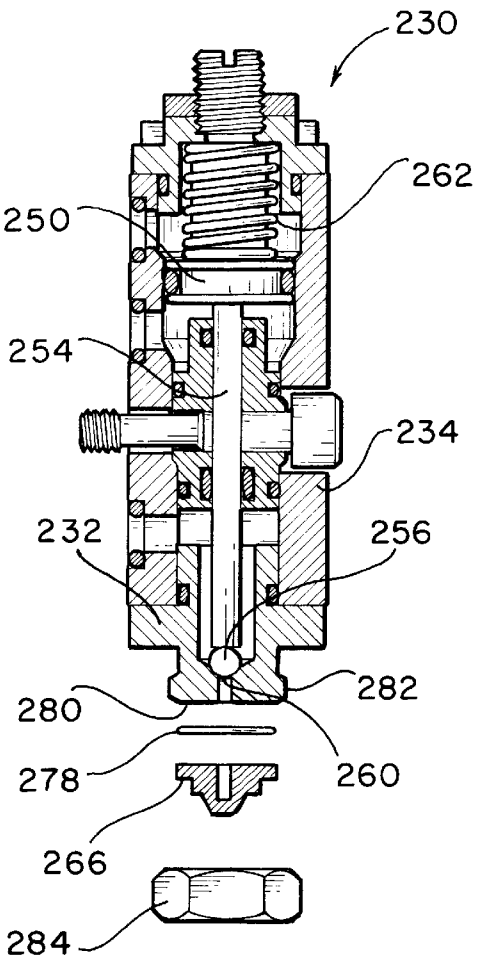
FIG. 4 is an exploded view, partially in cross-section and similar to that of FIG. 2 showing, however, a second embodiment of a new and improved hot melt adhesive valve dispensing assembly having the removable inline nozzle filter member or component incorporated therein.

With reference now being made briefly to FIG. 4, a second embodiment of a new and improved hot melt adhesive dispensing valve assembly, which again corresponds to any one of the plurality of hot melt adhesive dispensing valve assemblies 30 disclosed within FIG. 1, and which is operationally similar to the first embodiment of the hot melt adhesive dispensing valve assembly 130 as disclosed within FIG. 2, is disclosed and is generally indicated by the reference character 230. While the second embodiment hot melt adhesive dispensing valve assembly 230 is somewhat different in structure from the first embodiment of the hot melt adhesive dispensing valve assembly 130 disclosed within FIG. 2, the operation of the second embodiment of the hot melt adhesive dispensing valve assembly 230 is essentially similar to that of the first embodiment of the hot melt adhesive dispensing valve assembly 130, and therefore only a description of the pertinent structure of the second embodiment of the hot melt adhesive dispensing valve assembly 230, for the purposes of this patent disclosure, will be provided, while a detailed discussion of the remaining structure of the second embodiment of the hot melt adhesive dispensing valve assembly 230 will be omitted, although some of the components of the second embodiment of the hot melt adhesive dispensing valve assembly 230 which correspond to similar components of the first embodiment of the hot melt adhesive dispensing valve assembly 130 will be designated by similar reference characters.

More particularly, in lieu of the dispensing valve assembly adapter 232 having a recessed portion or socket within which the inline nozzle filter member is adapted to be disposed, the adapter 232 of the valve assembly 230 is provided with a front face 280 upon which the inline nozzle filter 278 is adapted to be seated. The forward end of the adapter 232 is also provided with an annular externally threaded flanged portion 282, and a nut member 284, which is adapted to encompass or encircle the dispensing nozzle 266, is adapted to be threadedly engaged with the threaded flanged portion 282 of the adapter 232 so as to securely mount the dispensing nozzle 266 and the inline nozzle filter 278 upon the dispensing valve adapter 232.

Figure 5:
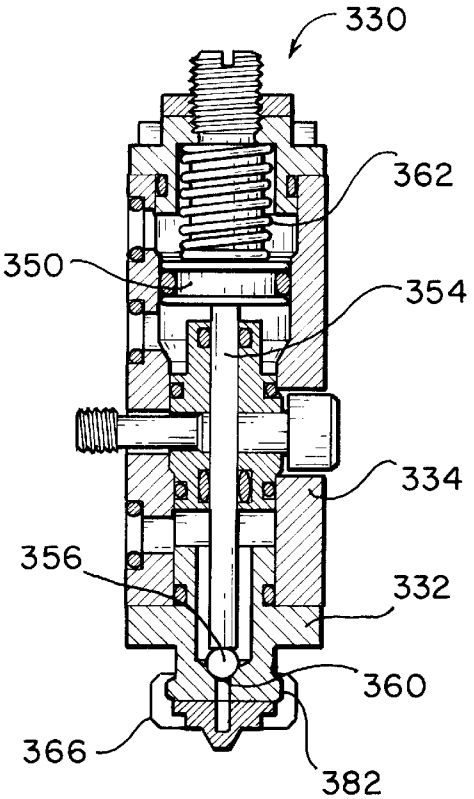
FIG. 5 is an assembled view, partially in cross-section and similar to those of FIGS. 2 and 4 showing, however, a third embodiment of a new and improved hot melt adhesive valve dispensing assembly having the removable inline nozzle filter member or component incorporated therein.

With reference now being made to FIG. 5, a third embodiment of a new and improved hot melt adhesive dispensing valve assembly, which again corresponds to any one of the plurality of hot melt adhesive dispensing valve assemblies 30 as disclosed within FIG. 1, and which is operationally similar to the first and second embodiments of the hot melt adhesive dispensing valve assemblies 130,230 as disclosed within FIGS. 2 and 4, is disclosed and is generally indicated by the reference character 330. As was the case with the second embodiment of the valve assembly 230, while the third embodiment hot melt adhesive dispensing valve assembly 330 is somewhat different in structure from the first and second embodiments of the hot melt adhesive dispensing valve assembly 130,230 disclosed within FIGS. 2 and 4, the operation of the third embodiment of the hot melt adhesive dispensing valve assembly 330 is essentially similar to that of the first and second embodiments of the hot melt adhesive dispensing valve assembly 130,230 and therefore only a description of the pertinent structure of the third embodiment of the hot melt adhesive dispensing valve assembly 330, for the purposes of this patent disclosure, will be provided, while a detailed discussion of the remaining structure of the third embodiment of the hot melt adhesive dispensing valve assembly 330 will be omitted, although some of the components of the third embodiment of the hot melt adhesive dispensing valve assembly 330 which correspond to similar components of the first and second embodiments of the hot melt adhesive dispensing valve assembly 130,230 will be designated by similar reference characters.

More particularly, the hot melt adhesive dispensing valve assembly 330 is essentially identical to the hot melt adhesive dispensing valve assembly 230 shown in FIG. 4 except for the fact that in lieu of the nut member 284 and the dispensing nozzle 266 comprising separate components, in accordance with the teachings and principles of the third embodiment of the hot melt adhesive dispensing valve assembly 330, the nut member and dispensing nozzle comprise a single integral dispensing nozzle component 366. In particular, the dispensing nozzle 366 comprises a nozzle member which has an internally threaded portion which is adapted to threadedly engage the externally threaded flanged portion 382 of the dispensing valve adapter 332. It is of course to be understood that while not shown in this particular drawing figure, the inline nozzle filter is again interposed between the threaded dispensing nozzle component 366 and the front face of the adapter 332 as was the case in connection with the second embodiment of the dispensing valve assembly 230 shown in FIG. 4.

Figure 6:
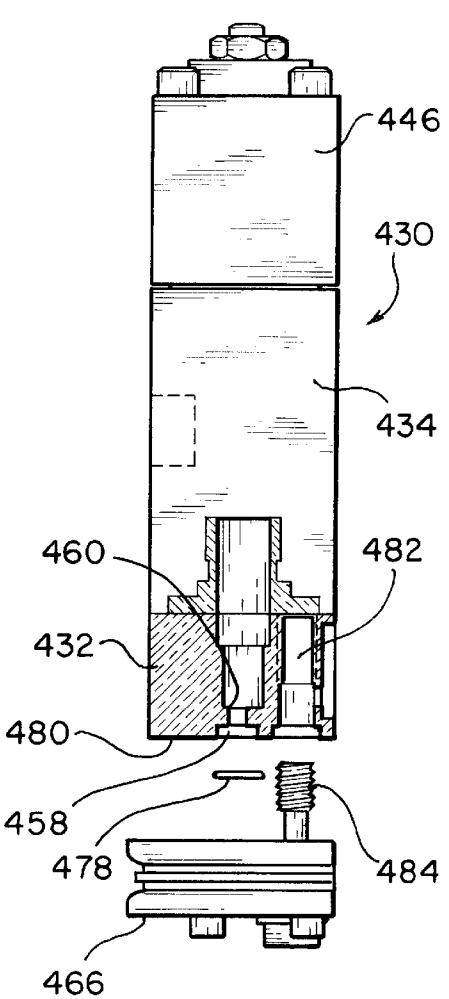
FIG. 6 is an exploded view, partially in cross-section, similar to those of FIGS. 2,4, and 5 showing, however, a fourth embodiment of a new and improved hot melt adhesive valve dispensing assembly having the removable inline nozzle filter member or component incorporated therein.

Lastly, with reference now being made to FIG. 6, a fourth embodiment of a new and improved hot melt adhesive dispensing valve assembly, which again corresponds to any one of the plurality of hot melt adhesive dispensing valve assemblies 30 as disclosed within FIG. 1, and which is operationally similar to the first, second, and third embodiments of the hot melt adhesive dispensing valve assemblies 130,230,330 as disclosed within FIGS. 2,4 and 5, is disclosed and is generally indicated by the reference character 430. As was the case with the second and third embodiments of the valve assembly 230,330, while the fourth embodiment hot melt adhesive dispensing valve assembly 430 is somewhat different in structure from the first,second, and third embodiments of the hot melt adhesive dispensing valve assembly 130,230,330 disclosed within FIGS. 2,4 and 5, the operation of the fourth embodiment of the hot melt adhesive dispensing valve assembly 430 is essentially similar to that of the first, second, and third embodiments of the hot melt adhesive dispensing valve assembly 130,230,330 and therefore only a description of the pertinent structure of the fourth embodiment of the hot melt adhesive dispensing valve assembly 430, for the purposes of this patent disclosure, will be provided, while a detailed discussion of the remaining structure of the fourth embodiment of the hot melt adhesive dispensing valve assembly 330 will be omitted, although some of the components of the fourth embodiment of the hot melt adhesive dispensing valve assembly 430 which correspond to similar components of the first, second, and third embodiments of the hot melt adhesive dispensing valve assembly 130,230,330 will be designated by similar reference characters.

More particularly, the dispensing valve adapter 432 is provided with a shallow recessed portion 458 within the front or forward face 480 within which the inline nozzle filter 478 is adapted to be disposed. The adapter 432 is further provided with a threaded socket 482, and the valve dispensing nozzle component 466 comprises a fixture which is provided with an axially projecting threaded screw member 484 for threaded engagement with the threaded socket 482 of the adapter 432. Accordingly, when the screw member 484 is threadedly engaged within the threaded socket 482 of the dispensing valve adapter 432, the nozzle fixture 466 is fixedly secured upon the dispensing valve adapter 432 and thereby secures the inline nozzle filter 478 within the recessed portion 458.

Thus, it may be seen that in accordance with the principles and teachings of the present invention, there has been provided a new and improved removable inline nozzle filter which comprises a filter member or component which is mounted within the hot melt adhesive dispensing valve assembly at a position or location which is immediately upstream of the hot melt adhesive dispensing valve assembly nozzle. The filter member or component is interposed between the valve seat for the hot melt adhesive dispensing valve which is formed within the hot melt adhesive dispensing valve assembly adapter and the hot melt adhesive dispensing valve assembly nozzle which is threadedly mounted within the adapter. As a result of this disposition of the nozzle filter, any residual or remaining particles or debris, which were not previously filtered, caught, or trapped by means of the primary filter component disposed within the filter block of the hot melt adhesive dispensing head assembly will now be filtered, caught, and trapped by means of the inline nozzle filter component whereby clogging or blocking of the valve assembly dispensing nozzle is effectively prevented.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A fluid dispensing valve assembly, comprising:

a valve adapter;

a valve seat defined within said valve adapter;

a valve member axially movable between a first position at which said valve member is seated upon said valve seat so as to prevent dispensing of a fluid through said valve assembly, and a second position at which said valve member is unseated with respect to said valve seat so as to permit dispensing of a fluid through said valve assembly;

a dispensing nozzle mounted upon said valve adapter for dispensing a fluid from said valve assembly; and a nozzle filter mounted upon said valve adapter at an axial position downstream of said valve seat and upstream of said dispensing nozzle for filtering particle debris, which may be disposed within the fluid, so as to prevent such particle debris from clogging said dispensing nozzle.

2. The valve assembly as set forth in claim 1, wherein:

an internally threaded recessed socket portion is defined within said valve adapter; and said dispensing nozzle is externally threaded for threaded engagement with said internally threaded recessed socket portion such that said dispensing nozzle is fixedly but removably mounted upon said valve adapter.

3. The valve assembly as set forth in claim 2, wherein:

said nozzle filter is disposed within said recessed socket portion of said valve adapter.

4. The valve assembly as set forth in claim 3, wherein:

an end wall of said recessed socket portion defines said valve seat.

5. The valve assembly as set forth in claim 4, wherein:

said nozzle filter is disposed within said recessed socket portion of said valve adapter so as to be disposed upon the downstream side of said end wall defining said valve seat.

6. The valve assembly as set forth in claim 5, wherein:

said nozzle filter is interposed between said dispensing nozzle and said end wall of said recessed socket portion defining said valve seat.

7. The valve assembly as set forth in claim 1, wherein:

said valve adapter comprises an externally threaded flanged portion; and an internally threaded nut member is provided for threadedly engaging said externally threaded flanged portion of said valve adapter for securing said dispensing nozzle and said nozzle filter upon said valve adapter.

8. The valve assembly as set forth in claim 1, wherein:

said valve adapter comprises an externally threaded flanged portion; and said dispensing nozzle is internally threaded for threadedly engaging said externally threaded flanged portion of said valve adapter so as to secure said dispensing nozzle and said nozzle filter upon said valve adapter.

9. The valve assembly as set forth in claim 1, wherein:

said valve adapter comprises an internally threaded socket portion; and said dispensing nozzle comprises an externally threaded screw member for threadedly engaging said internally threaded socket portion of said valve adapter so as to secure said dispensing nozzle and said nozzle filter upon said valve adapter.

10. A hot melt adhesive dispensing valve assembly, comprising:

a valve adapter;

a valve seat defined within said valve adapter;

a valve member axially movable between a first position at which said valve member is seated upon said valve seat so as to prevent dispensing of a hot melt adhesive through said valve assembly, and a second position at which said valve member is unseated with respect to said valve seat so as to permit dispensing of a hot melt adhesive through said valve assembly;

a dispensing nozzle mounted upon said valve adapter for dispensing a hot melt adhesive from said valve assembly; and a nozzle filter mounted upon said valve adapter at an axial position downstream of said valve seat and upstream of said dispensing nozzle for filtering particle debris, which may be disposed within the hot melt adhesive, so as to prevent such particle debris from clogging said dispensing nozzle.

11. The valve assembly as set forth in claim 10, wherein:

an internally threaded recessed socket portion is defined within said valve adapter; and said dispensing nozzle is externally threaded for threaded engagement with said internally threaded recessed socket portion such that said dispensing nozzle is fixedly but removably mounted upon said valve adapter.

12. The valve assembly as set forth in claim 11, wherein:

said nozzle filter is disposed within said recessed socket portion of said valve adapter.

13. The valve assembly as set forth in claim 12, wherein:

an end wall of said recessed socket portion defines said valve seat.

14. The valve assembly as set forth in claim 13, wherein:

said nozzle filter is disposed within said recessed socket portion of said valve adapter so as to be disposed upon the downstream side of said end wall defining said valve seat.

15. The valve assembly as set forth in claim 14, wherein:

said nozzle filter is interposed between said dispensing nozzle and said end wall of said recessed socket portion defining said valve seat.

16. The valve assembly as set forth in claim 10, wherein:

said valve adapter comprises an externally threaded flanged portion; and an internally threaded nut member is provided for threadedly engaging said externally threaded flanged portion of said valve adapter for securing said dispensing nozzle and said nozzle filter upon said valve adapter.

17. The valve assembly as set forth in claim 10, wherein:

said valve adapter comprises an externally threaded flanged portion; and said dispensing nozzle is internally threaded for threadedly engaging said externally threaded flanged portion of said valve adapter so as to secure said dispensing nozzle and said nozzle filter upon said valve adapter.

18. The valve assembly as set forth in claim 10, wherein:

said valve adapter comprises an internally threaded socket portion; and said dispensing nozzle comprises an externally threaded screw member for threadedly engaging said internally threaded socket portion of said valve adapter so as to secure said dispensing nozzle and said nozzle filter upon said valve adapter.

* * * * *